United States Patent [19]

Kimoto et al.

[11] Patent Number: 4,594,777

[45] Date of Patent: Jun. 17, 1986

[54] ELECTRIC SHAVER WITH A DRIVE REGULATOR

[75] Inventors: Yutaka Kimoto, Sumoto; Toru Morioka, Hyogo; Yasuo Mitani, Sumoto, all of Japan

[73] Assignee: Sanyo Electric Co., Ltd., Japan

[21] Appl. No.: 530,210

[22] Filed: Sep. 8, 1983

[30] Foreign Application Priority Data

Sep. 16, 1982 [JP] Japan ..... 57-1618895
Jan. 27, 1983 [JP] Japan ..... 58-12195
Jan. 27, 1983 [JP] Japan ..... 58-12196

[51] Int. Cl.[4] ..... B26B 19/02
[52] U.S. Cl. ..... 30/42; 320/59
[58] Field of Search ..... 30/43–46, 30/40, 42; 318/305, 347, 348; 323/352; 307/317, 317 A, 146; 320/59

[56] References Cited

U.S. PATENT DOCUMENTS 3,245,145 4/1966 Buford ..... 30/43.5
3,290,781 12/1966 Kratz ..... 30/43.1 X
4,460,863 7/1984 Comforti ..... 320/59

*Primary Examiner*—Douglas D. Watts
*Attorney, Agent, or Firm*—Darby & Darby

[57] ABSTRACT

An electric shaver is described which comprises: a housing; a fixed cutter mounted to the housing; and a movable cutter arranged to slide along the fixed cutter. A driving motor is linked to the movable cutter for slidably moving the movable cutter along the fixed cutter. A power supply circuit is electrically connected to the driving motor for supplying a selectively controllable voltage to the driving motor. The power supply circuit comprises a charging circuit and a control circuit. The charging circuit includes a voltage reducing transformer, and a rectifying element and a rechargeable battery connected in series with the secondary coil of the voltage reducing transformer. The control circuit is connected to the driving motor in parallel to the rechargeable battery. The control circuit includes a starting switch and at least one voltage drop element having a substantially constant voltage characteristic. The starting switch and the voltage drop element are connected in series with the driving motor. The control circuit further includes means for selectively providing a short circuit providing means is connected in parallel to the voltage drop element and in parallel to the voltage drop element and includes an operator controllable switch mounted to the housing for selectively shorting the voltage drop element.

9 Claims, 34 Drawing Figures

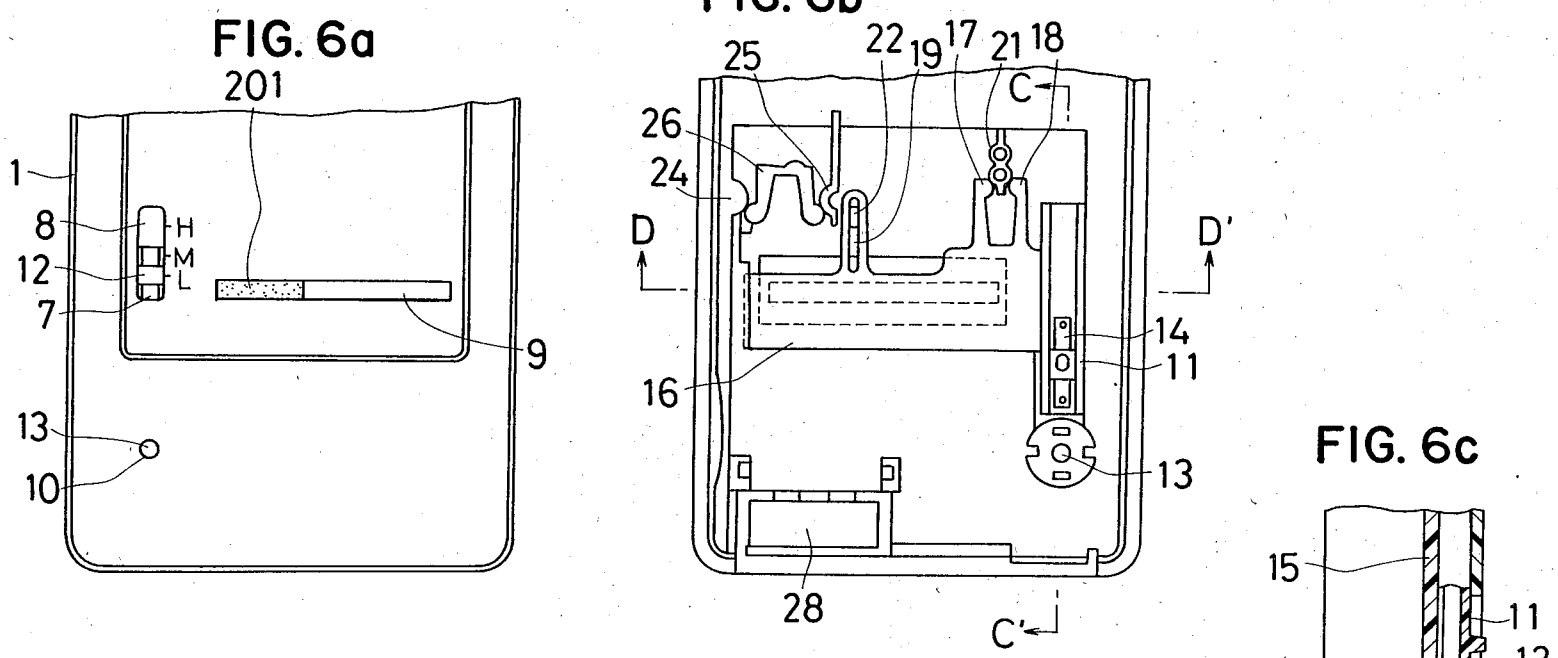
FIG. 6a
201
9
H
M
L
1
8
12
7
13
10
FIG. 6b
D'
14
11
13
18
C
21
17
19
22
25
26
24
D
16
28
C'
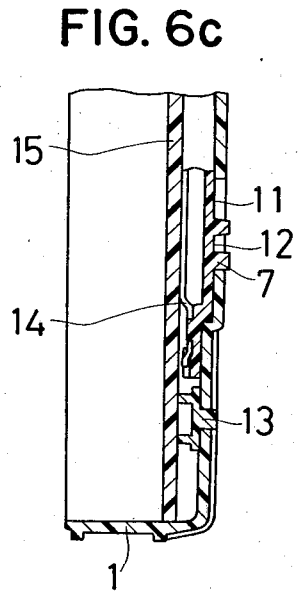
FIG. 6c
11
12
7
13
1
15
14
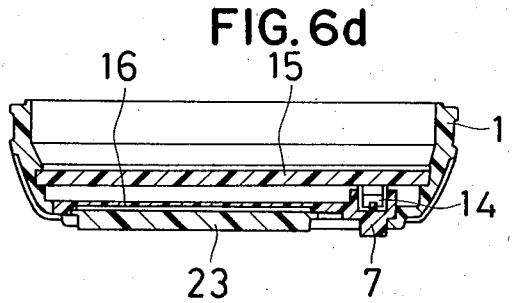
FIG. 6d
1
14
7
15
23
16

FIG. 9a
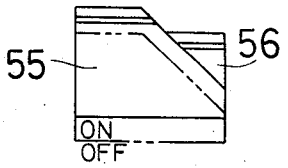
FIG. 10a
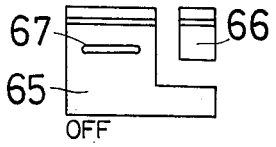
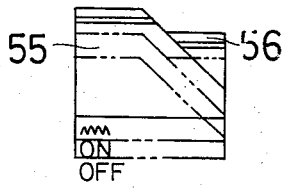
FIG. 9b
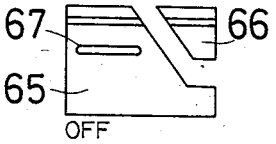
FIG. 10b
FIG. 11a
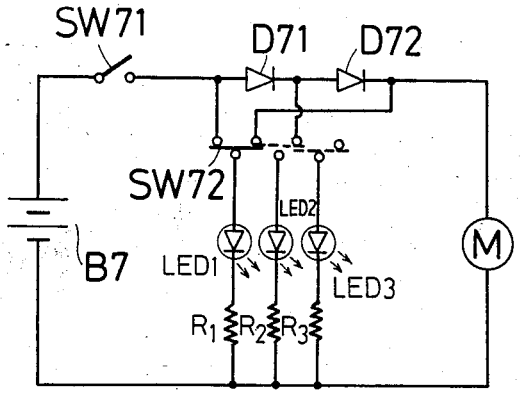
FIG. 11b
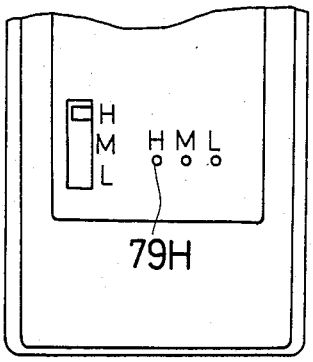

ELECTRIC SHAVER WITH A DRIVE REGULATOR

BACKGROUND OF THE INVENTION

1. Field of the invention

This invention relates to an electric shaver, and more particularly to an electric shaver providing a mechanism for regulating cutter driving speed, i.e. movable cutter driving speed against a fixed cutter.

2. Description of the prior art

It is known that the cutting quality of an electric shaver is influenced upon the driving speed of the movable (inner) cutter and moreover the optimum driving speed is varied upon the thickness of the beard to be cut.

Table 1 illustrates differences in after-shave feelings for persons who have thick or light beards; for instance, those who have heavy beards insist that the slower (L) the inner cutter driving speed, the shorter the beard is cut. On the contrary, those having light beards assert that the faster (H) the driving speed, the shorter the beard is cut. Thus the feeling is individually diversified.

TABLE 1

| Criterion | Driving speed | Heavy beard | Light beard |
|---|---|---|---|
| Sharp | H | | |
| | L | | |
| Short | H | | |
| | L | | |
| Quick | H | | |
| | L | | |
| Smooth | H | | |
| | L | | |
| Soft | H | | |
| | L | | |
| Catching | H | | |
| | L | | |

However, it is difficult to simply change the inner cutter driving speed in conventional electric shavers. Attempts were made to improve after-shave feeling by attaching a trimmer for cutting sideburns in agreement with the portion where the beard is shaven or a comb cutter on the periphery of the fixed (outer) cutter for guiding the beard (for instance, see U.S. Pat. No. 3,552,007). These attempts do not concern to change the driving speed of the movable cutter.

SUMMARY OF THE INVENTION

In accordance with the present invention, it provides an electric shaver comprising a housing, a fixed cutter installed in the housing, a movable cutter so arranged that said movable cutter is allowed to slide along the fixed cutter, a driving motor for driving said movable cutter, a power supply circuit of said driving motor, a starting switch provided in said supply circuit, and a knob for operating said starting switch mounted on the housing, in which said power supply circuits is further provided with a circuit for changing the voltage applied to said driving motor and an activating switch for said circuit, and a knob for operating said activating switch so that the sliding speed of said movable cutter can be changed by moving said knob for operating the activating switch.

The electric shaver of the invention has an advantage that the disired cutting quality is achieved by simply operating a knob to suit every one's feeling where the driving speed of the movable (inner) cutter is made changeable.

BRIEF DESCRIPTION OF THE DRAWINGS

The drawings relate to electric shavers as exemplary embodiments of the present invention.

FIG. 6*a* is a front view of the principal portion in FIG. 1; FIG. 6*b* is a rear elevation of (a); FIG. 6*c* is a C—C′ sectional view of (b); FIG. 6*d* is a D—D′ sectional view of (b).

FIGS. 9*a*, and *b* are diagrams explanatory of the operation of a switch. FIGS. 10*a*, *b* are diagrams explanatory of the operation of another embodiment of the switch.

FIG. 11*a* is a circuit diagram illustrating another embodiment of cutter speed indication; FIG. 11*b* is a front view of the principal portion of the reciprocating type electric shaver employing the cutter speed indication.

FIG. 12*b* (1)–(6) is a perspective view of another embodiment of the cutter speed indicating method.

FIG. 13*b* (1)–(3) is a diagram explanatory of the embodiment.

DESCRIPTION OF THE PREFERRED EMBODIMENTS

Figure 1:
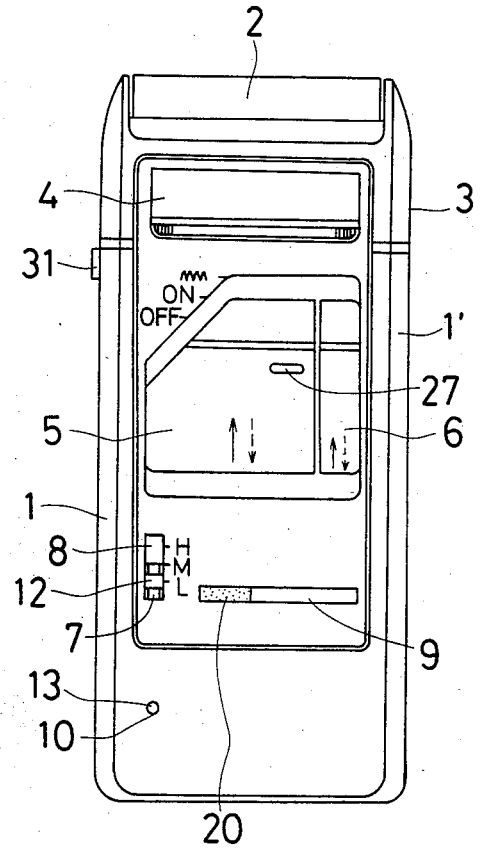
FIG. 1 is a front view of a reciprocating type electric shaver as one preferred embodiment of the invention.

Referring now to FIGS. 1 through 7, description is made of one exemplary embodiment of the present invention in the form of a reciprocating type electric shaver with a trimmer.

A housing 1 made of synthetic resin comprises an outer cutter frame 3 prepared by aluminum die casting with an outer cutter 2 of a thin metal sheet as a fixed cutter having a number of perforated holes for guiding the beard and a lower case 1' mounting and engaging with the outer cutter frame 3. The housing 1 is equipped on its front with a trimmer 4 having a upper cutter as a fixed cutter and a lower cutter as a movable cutter in such a manner as is retractable. Numeral 31 indicates a button used to install and detach the outer cutter frame 3.

Numeral 5 is a starting switch knob with an large area for causing an inner cutter (not shown) as a movable cutter to start moving, the inner cutter being allowed to slide on the inside surface of the outer cutter 3 mounted on the outer cutter frame 3, the starting switch knob being movable to three positions: OFF, ON, ⩘. A trimmer driving knob 6 for setting the trimmer 4 to position for use and causing it to drive is arranged transversely in parallel with the switch knob. Thus both the switch and trimmer driving knobs 5, 6 can be slid in the same direction.

Moreover, there is also provided a knob 7 for operating a changeover switch (SW2) for changing inner cutter driving speed (the number of oscillations) on the front panel of the housing 1. The knob 7 can be set to three positions, namely, high (H), medium (M) and low (L) speeds. On the front panel of the housing 1, a vertical slit 8, a horizontal slit 9 and a circular hole 10 are arranged as shown in FIG. 1. The knob 7 is protruded from the inner surface of the housing 1 in the vertical slit 8 and incorporated in a sliding guide plate 11 (see FIG. 7 in particular) wider than the vertical slit 8. A notch 12 large enough for the tip of a screwdriver to be inserted is made near the center of the knob 7. A charge indicator lamp 13 is also installed in the circular hole 10.

Figure 2:
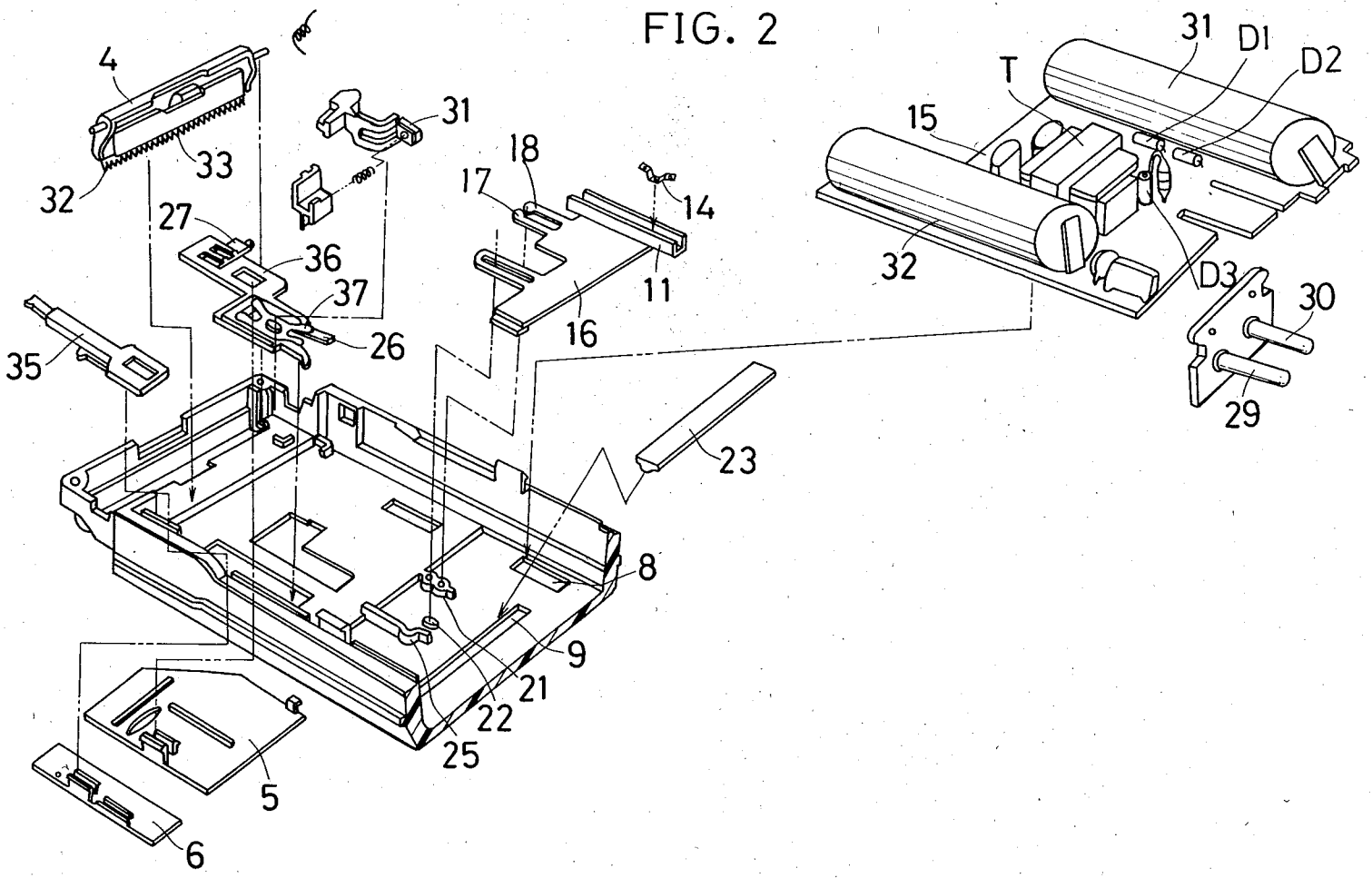
Fig. 2 is an exploded perspective view of the principal portion of the electric shaver.

An armature 14 is deposited on the rear side of the sliding guide plate 11 (see FIG. 2). This armature 14 is made to contact a printed circuit board 15 on which a driving circuit of a driving d.c. motor (M) and a supply connecting circuit (see FIG. 3) have been printed (see FIGS. 6*c*, *d*)

Figure 7:
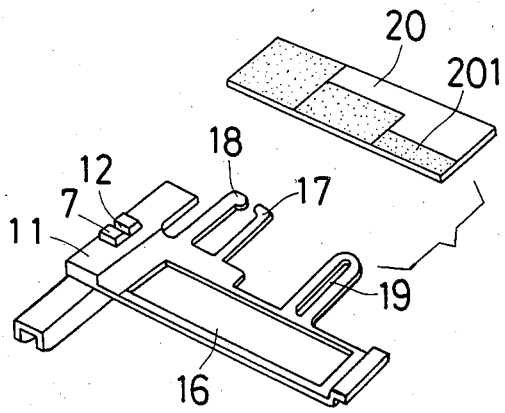
FIG. 7 is an exploded perspective view of an indicator.

Referring to FIGS. 6 and 7 in particular, there is shown an indicator 16 extending across the sliding guide plate 11. The indicator 16 is provided with a pair of flexible legs 17, 18 for click-stop mechanism of the sliding guide plate 11 on one side and a sliding guide hole 19 in the protruded portion on the other side and a display panel 20 with a tiered pattern is glued to the front surface of the indicator 16. On the other hand, an 8-shaped dimple 21 for click-stop mechanism of the sliding guide plate 11 and a sliding guide boss 22 are provided on the rear side of the housing 1 in such a way that they correspond to the legs 17, 18 and the guide hole 19, respectively. In addition, a convex lens 23 made of transparent synthetic resin is attached to the horizontal slit 9, so that the display panel 20 of the indicator 16 can be recognized from outside through the convex lens 23.

Embossed portions 24, 25 constituting the carriage click-stop mechanism of the inner cutter driving knob 5 are formed on the rear side of the housing 1 and embossed portions of a flexible leg 26 formed on an operating member 36 of the inner cutter driving knob 5 is caught by the embossed portions 24, 25. Moreover, numeral 35 is an operating member of the trimmer driving knob 6, the upper end of which rotates the trimmer (or trimmer cutter unit) 4 to set it into a driving position. An armature 37 is also set on the operating member 36, which is made to properly contact the printed circuit board 15.

Numeral 27 is a lock button of the starting switch knob 5 and the button is used to control the movement of the knob 5 by attaching to and detaching from the rear side of the housing 1.

A containing room 28 contains pin plugs 29, 30, which receive current supplied from a power supply outlet at home and supply the current to rechargeable batteries 31, 32 in the housing 1 or directly to a motor M.

A circuit diagram in FIG. 3 is subsequently described. The housing 1 contains the driving motor M for driving the inner cutter and the lower cutter 33 of the trimmer 4 (see FIG. 2), a rectifying diode D3, Schottky diodes Dl, D2 and a rechargeable battery B as a power supply (see U.S. Pat. No. 4,194,238 for details of the charging circuit) and they are connected with each other as shown in FIG. 3*a*; that is, the rechargeable battery B, rectifying diode D3, and Schottky diodes Dl, D2 are connected to the motor M in series. Each terminal of the Schottky diodes Dl, D2 is connected to the changeover switch SW2 operated by the knob 7 to constitute a circuit for changing the voltage applied to the driving motor, whereas the rectifying diode D3 is connected to one end of the secondary coil of a voltage reducing transformer T.

If the position of the starting switch SW1 is moved one step upward from the lowest OFF using the starting switch knob 5, the starting switch SW1 will be closed, causing the inner cutter to oscillates as the motor M is driven to turn. If the changeover switch SW2 is located at the high speed postiion (H), the current will be supplied to the motor M from the (+) side of the rechargeable battery B via a point Pl, the changeover switch SW2 and then a point P2. The motor M is thus caused to turn at high speed (7,000 r.p.m.) and this is accompanied by the driving of the inner cutter or the inner cutter and the lower cutter 33 of the trimmer 4 at the high speed (see FIG. 3*b*). When the changeover switch SW2 is located at the medium speed position (M), the current is supplied from the (+) side of the rechargeable battery B via the point Pl, the changeover switch SW2, the point P3, the Schottky diode D2 and then the point P2 to the motor M, which is then turned at medium speed (5,750 r.p.m.). Consequently, the inner cutter or the inner cutter and the lower cutter 33 of the trimmer 4 are driven at the medium speed (see FIG. 3*c*) because of a voltage drop caused by the diode D2. When the changeover switch is located at the low speed position L, voltage is applied to the motor M from the (+) side of the rechargeable battery B via the Schottky diode Dl, the point P3, the Schottky diode D2, and the point P2, and the motor is turned at low speed (4,500 r.p.m.). As a result, the inner cutter or the inner cutter and the lower cutter 33 of the trimmer 4 is driven at the low speed (see FIG. 3*d*).

Figure 5:
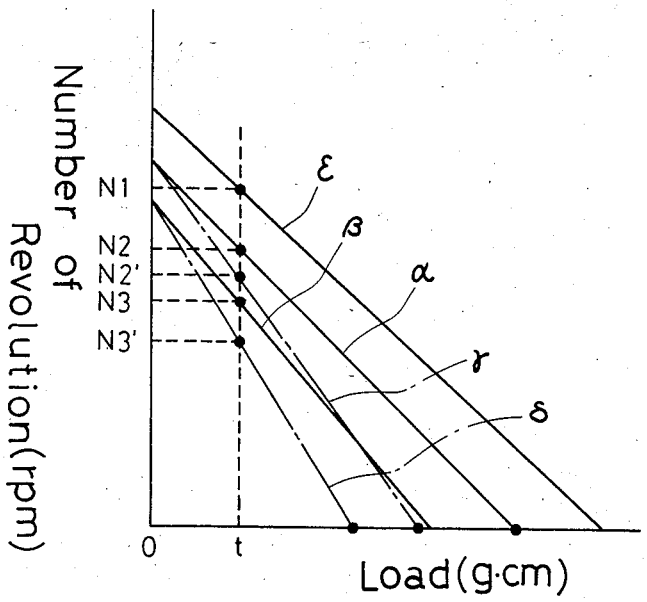
FIG. 5 is a graph of load characteristics in (b), (c), (d) of FIG. 3.

In this exemplary embodiment of the invention, a Schottky diode is used as the diode. In the case of the Schottky diode, current begins to rapidly flow as a curve e shown in FIG. 4 when the voltage exceeds the threshold level. Accordingly, the load characteristic curve shown by ($\alpha$) in FIG. 5 is obtained for the motor M corresponding to what is shown in FIG. 3*c*. On the other hand, the current increasing ratio for an ordinary diode as voltage increases is, as a curve f shown in FIG. 4, more slacken than that for a Schottky diode and the load characteristic curve shown by ($\gamma$) in FIG. 5 is obtained. The comparison of their actions for the rated load (t) shows that, on the basis of the slopes of the load characteristic curves of and (α) and (γ), the variation of the load is smaller than that of the number of revolutions, and motor driving is stable; in addition, a difference in the number of revolutions given by (N2) and (N2') in Fig.5. Thus, the advantage of using a Schottky diode is that the variations in the speed (rpm) of the driving motor is minimized regardless of loading conditions (presence or absence of a load).

Since the threshold voltage will be doubled if two Schottky diodes are connected to the motor M in series, the voltage applied to the motor M is further reduced. In this case, however, the load characteristic curve indicates almost the same slope shown by (62 ) in FIG. 5 as (α); as compared with the case of two ordinary diodes connected in series such as a slope shown by (δ) in FIG. 5, the number of revolutions at the rated load (t) is also N3>N3'. (ε) in FIG. 5 shows the load characteristic curve when the motor M is directly connected to the supply.

As above described, the electric shaver 1 comprises an outer cutter mounted on a housing, a trimmer arranged near the outer cutter, a switch knob causing an inner cutter sliding on the inside surface of the outer cutter, a trimmer switch knob for setting the trimmer to position for use, both the switches being arranged close to each other in parallel in such a manner as to slide in the same direction, and an operating knob below both the switches for changing inner cutter driving speed, the operating knob being allowed to freely slide, whereby it is capable of offering excellent usability with a one step operation for driving the trimmer and simply changing inner cutter or lower cutter of the trimmer 33 driving speed because both the switch knobs and the operating knob are located on the same side. Accordingly, this electric shaver is highly effective to cope with beards growing in different ways depending on the location, superior in a decorative design and practical as switches have been concentrated in a particular region.

Figure 8A:
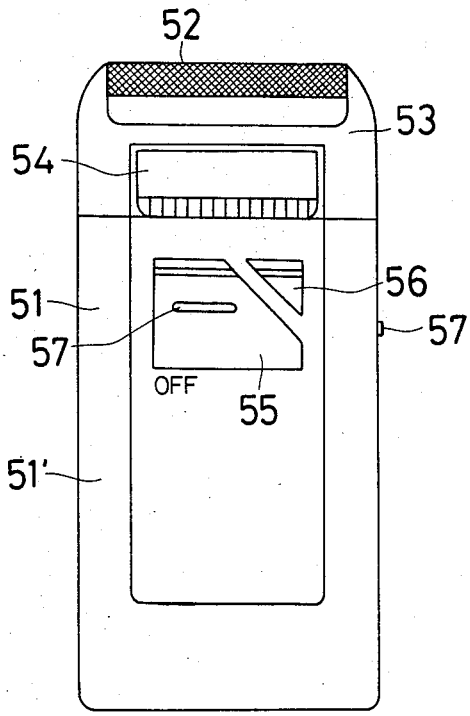
FIG. 8*a* is a front view of another embodiment of the reciprocating type electric shaver.
Figure 8B:
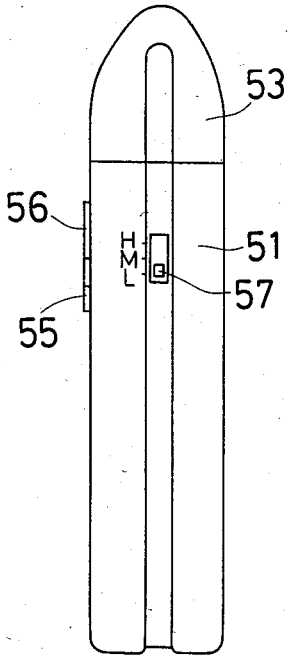
FIG. 8*b* is a side view of the shaver.

Subsequently referring to FIGS. 8 and 9, description is made of an oscillating type electric shaver 51 different in knobs from what is shown in FIGS. 1 through 7.

An inner cutter starting knob 55 is used to cause an inner cutter (not shown) allowed to slide on the inside surface of an outer cutter 52 mounted on an outer cutter frame 53 to start moving and moved to three different positions. A trimmer driving switch 56 roughly triangular in shape is located diagonally above the starting knob in such a manner as is able to slide upwardly and downwardly. This trimmer driving switch 56 is movable interlockingly with the starting switch knob 55.

Moreover, a knob 57 for operating a changeover switch is installed on the side of the housing 51 in order to change inner cutter driving speed (the number of oscillations) and the switch can be set to three positions: high speed (H), medium speed (M) and low speed (L).

FIG. 10*a*, *b* illustrate other embodiment of the starting switch knob 65 and trimmer driving knob 66. The trimmer driving knob 66 can be operated interlockingly with the upward and downward operation of the starting switch knob 65. Numeral 67 is a lock button which provides locking operation when the starting switch knob 65 is located at OFF position.

Referring to FIGS. 11*a*, *b*, another embodiment of indication when driving speed of inner cutter or inner cutter and lower cutter of the trimmer 54 is changed will be described. By the operation of a changeover switch SW72 for changing speed of revolution of a moter M, a light emission diode, for instance, LED 1 lights, emitting light from an indication opening 79H.

Figure 12A:
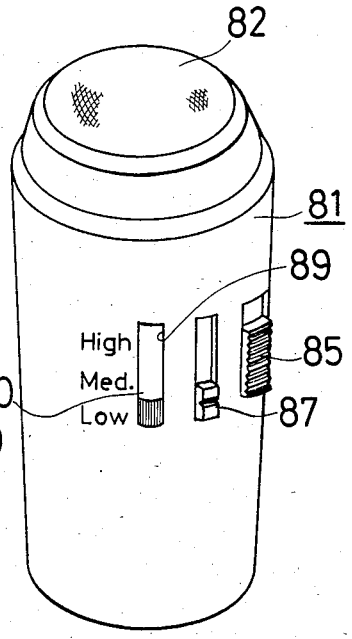
FIG. 12*a* is a perspective view of an embodiment of an electric shaver with a rotary shaving head, illustrating its switch and cutter speed indicating method.
Figure 12A:
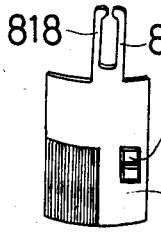
Figure 12C:
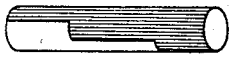
FIG. 12*c* is a perspective view of a display panel for use in the present invention.
Figure 12C:
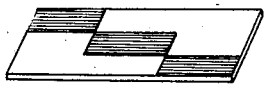
Figure 12C:
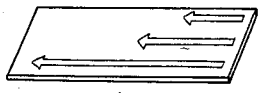
Figure 12C:
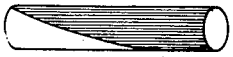
Figure 12C:
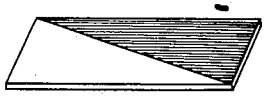
Figure 12C:
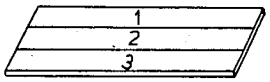

In FIG. 12*a*, a rotary type electric shaver 81 is equipped with a dome-shaped outer cutter 82, an inner cutter (not shown) allowed to rotatably slide on the inside surface of the outer cutter 82, a knob 85 for operating a main starting switch, another knob 87 for operating a changeover switch for changing inner cutter driving speed a speed indication opening 89 and its display panel 820, also shown in FIG. 12*c*. FIGS. 12*b* (1)–(6) show another embodiment of the display panel 820.

Figure 3A:
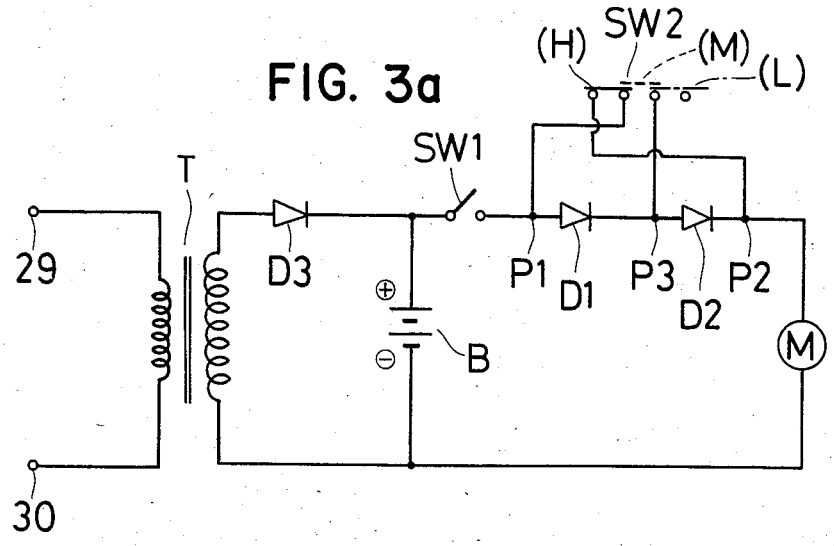
FIG. 3*a* is a circuit diagram.
Figure 3B:
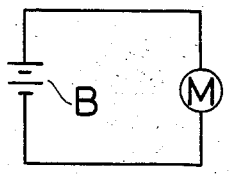
FIG. 3*b* is a circuit diagram of the principal portion when a changeover switch is located at H.
Figure 3C:
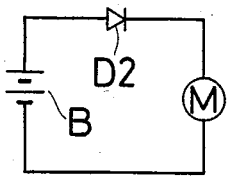
Fig. 3*c* circuit diagram of the principal when the changeover switch is located at M.
Figure 3D:
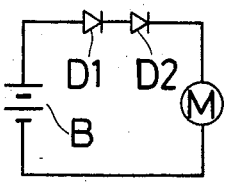
FIG. 3*d* is a circuit diagram of the principal portion when the changeover is located at L.
Figure 4:
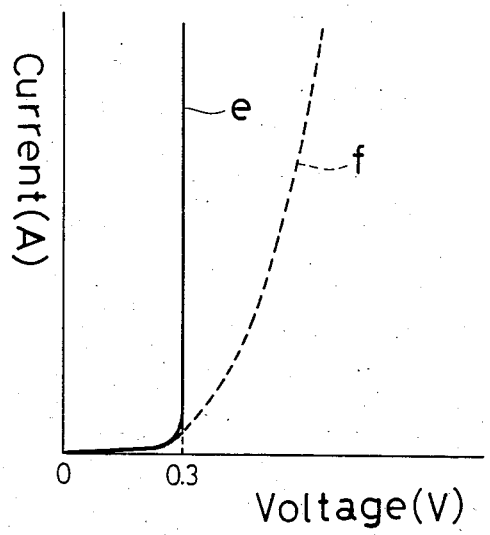
FIG. 4 the current-voltage curve of a diode.
Figure 13A:
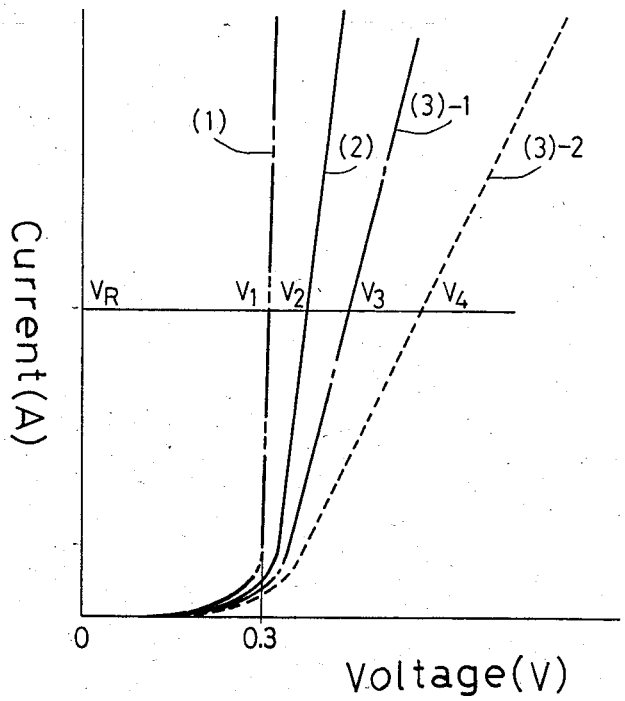
FIG. 13*a* is a graph of the current-voltage curve of another embodiment in place of the diode in FIG. 4.
Figure 13A:
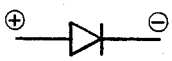
Figure 13A:
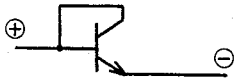
Figure 13A:
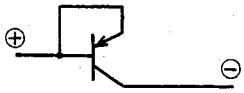
Figure 13A:
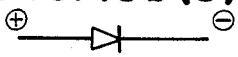

In addition to the Schottky diode as a voltage drop element shown in FIG. 3*a*, FIG. 11*a* and so on, the portion between the base and emitter of a transister or the base and collector thereof (forward direction) shown in FIGS. 13*b*–2 can be used. FIG. 13*a* shows the voltage-current characteristics of those inclusive of the Schottky diode 1 and ordinary diodes [curves (3)-1, (3)-2]. Any ordinary diode having characteristics whose slope is steeper than that of a curve (3)-1 may be used as a voltage drop element.

What is claimed is:

1. An electric shaver, which comprises:

a housing;

a fixed cutter mounted to the housing;

a movable cutter arranged to slide along the fixed cutter;

a driving motor linked to the movable cutter for slidably moving the movable cutter along the fixed cutter;

a power supply circuit electrically connected to the driving motor for supplying a selectively controllable voltage to the driving motor, the power supply circuit comprising a charging circuit and a control circuit, the charging circuit including a voltage reducing transformer, and a rectifying element and a rechargeable battery connected in series with the secondary coil of the voltage reducing transformer, the control circuit being connected to the driving motor in parallel to the rechargeable battery, the control circuit including a starting switch and at least one voltage drop element having a substantially constant voltage characteristic, the starting switch and the at least one voltage drop element being connected in series with the driving motor, the control circuit further including means for selectively providing a short circuit across the at least one voltage drop element, the short circuit providing means being connected in parallel to the at least one voltage drop element and including a operator controllable switch mounted to the housing for selectively shorting the at least one voltage drop element, the starting switch being mounted to the housing.

2. An electric shaver as claimed in claim 1, which further includes a knob mounted on the switch for selectively energizing the power supply circuit, and a knob mounted on the switch of the voltage changing circuit and positioned below the knob of the switch for selectively energizing the power supply circuit.

3. An electric shaver as claimed in claim 1, which further includes an indicator mounted in the housing for indicating the sliding speed of the movable cutter, the indicator being interlocked with the knob of the switch of the voltage changing circuit.

4. An electric shaver as claimed in claim 3, wherein said indicator comprises an indicator window and a display panel moving mechanically in said indicator window and interlockingly with the knob of the switch of the voltage changing circuit.

5. An electric shaver as claimed in claim 3, wherein said indicator comprises a light emission assembly operating to light as the knob of the switch of the voltage changing circuit is moved.

6. An electric shaver as defined by claim 1, wherein the at least one voltage drop element is a Schottky diode.

7. An electric shaver as defined by claim 1, wherein the at least one voltage drop element is a transistor.

8. An electric shaver as defined by claim 1, wherein the fixed cutter is an outer cutter mounted on the housing and the movable cutter is an inner cutter slidable on the inside surface of said outer cutter.

9. An electric shaver as defined by claim 8, wherein the outer cutter is an upper fixed cutter and the inner cutter is a lower movable cutter constituting a trimmer.

* * * * *